US006202459B1

(12) United States Patent
Palzer et al.

(10) Patent No.: US 6,202,459 B1
(45) Date of Patent: Mar. 20, 2001

(54) METHOD OF AND ROLLING MILL TRAIN FOR PRODUCING BAR-SHAPED ROLLED PRODUCTS

(75) Inventors: Otmar Palzer, Jüchen; Erich Grossmann, Tönisvorst; Hubert Müller, Grevenbroich, all of (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/479,609

(22) Filed: Jan. 7, 2000

(30) Foreign Application Priority Data

Jan. 8, 1999 (DE) ..... 199 00 428

(51) Int. Cl.[7] ..... B21B 37/68

(52) U.S. Cl. ..... 72/8.9; 72/11.6; 72/12.7; 72/12.8

(58) Field of Search ..... 72/7.6, 8.9, 9.2, 72/11.6, 11.8, 12.7, 12.8

(56) References Cited

U.S. PATENT DOCUMENTS 4,583,384 * 4/1986 Niino et al. ..... 72/9.2
4,607,511 * 8/1986 Shore ..... 72/234
5,305,624 * 4/1994 Backhaus ..... 72/235

FOREIGN PATENT DOCUMENTS 61-159217 * 7/1986 (JP) ..... 72/12.7
2-197310 * 8/1990 (JP) ..... 72/9.2

* cited by examiner

*Primary Examiner*—Ed Tolan
(74) *Attorney, Agent, or Firm*—Brown & Wood, LLP

(57) ABSTRACT

A method of rolling a bar-shaped stock to predetermined end height and end width measured transverse to the end height and including providing a rolling will train having a plurality of arranged one after another active rolling mill stands having adjustable roll rips and forming rolling mill stand pairs, providing a respective plurality of hydraulic cylinder units for adjusting the roll rips of respective rolling mil stands, rolling the bar-shaped stock through the rolling mill stands, and compensating at least a fraction, individually for each of the plurality of rolling mill stands, of rolling force-caused spring-offs of the respective rolling mill stands by controlling operations of respective hydraulic cylinder units.

22 Claims, 2 Drawing Sheets

METHOD OF AND ROLLING MILL TRAIN FOR PRODUCING BAR-SHAPED ROLLED PRODUCTS

BACKGROUND OF THE INVENTION

1. Field of the Invention

The present invention relates to a method of rolling of a bar-shaped stock, e.g., a bar steel or wire to predetermined end height and end width measured transverse to the end height by application of rolling forces, and to a rolling mill train for implementing the method and including a plurality of arranged one after another active rolling mill stands having adjustable roll nips and forming rolling mill stand pairs.

2. Description of the Prior Art

The rolling mill trains of the type described above are generally known. The rolling mill stands are alternatively formed as horizontal rolling mill stands and vertical rolling mill stands, with the last rolling mill stand defining the end profile, e.g., round, square or hexagonal profile.

In the prior art, the roll nips of the rolling mill stands are adjusted with electric or hydraulic motors. However, the adjustment of the roll nip can be mostly effected in the unloaded condition only. The adjustment of the roll nip under a load is not possible. It is possible to change the rotational speed of the rolling mill stands during their operation. Other interventions, e.g., a correction of roll nips, is not possible.

A co-pending U.S. application Ser. No. 09/348,745 discloses a rolling mill train for rolling a bar-shaped stock including a plurality of active rolling mill stands through which a rolled stock passes one after another and the roll nips of which are adjusted with respective hydraulic cylinder units. There are further provided control units for controlling the operation of the respective hydraulic cylinder units so that a fraction of the rolling force-caused spring-offs of the rolling mill stands is compensated.

An object of the present invention is to provide a method of and a rolling mill train for rolling a bar-shaped stock with which the roll nips can be adjusted under load and the rolling characteristics of the rolling mill stands are adaptable to respective rolled stock.

SUMMARY OF THE INVENTION

This and other objects of the present invention, which will become apparent hereinafter, are achieved by providing a rolling mill train having a plurality of arranged one after another, active rolling mill stands having adjustable roll nips and forming rolling mill stand pairs, a respective plurality of hydraulic cylinder units for adjusting the roll nips of respective rolling mill stands, and a respective plurality of roll nip control units for controlling the respective hydraulic cylinder units so that at least a fraction of rolling force-caused spring-offs of the respective rolling mill stands is compensated individually for each of the rolling mill stands. The provision of hydraulic cylinder units for adjusting of the roll nips permitted to adjust the roll nips under load. The capability to compensate the rolling force-caused spring-offs provided for an automatic compensation of the spring-offs. Because in this case, a possible rolling error would be completely transmitted to the width of the rolled stock, the spring-offs are only partially compensated. Due to the adjustability of the fractions to be compensated, the rolling mill stands can be adapted to their particular tasks in the rolling mill train.

The rolling mill stands in the rolling mill train perform different tasks, dependent on the rolled product, namely, they effect either a reduction of the rolled stock or so-called pre-sizing or sizing.

The primary task of the reduction stands is to reduce the stock cross-section to a most possible extent. These stands should be rather rigid. In connection with a monitor routine, the cross-section of the rolled stock can be optimized with such rolling mill stands.

The primary task of the pre-sizing stands is to bring the ratio of the stock height to the stock width to a certain value before the stock enters the following sizing stands. To this end, with a round end profile of the rolled stock, the stands with an oval pass should have a high rigidity, and the stands with a round pass should have an optimal rigidity. In such a case, the temperature and cross-sectional deviations will be uniformly distributed to both measurements.

The primary task of the sizing stands is to roll the rolled stock to the desired end dimensions and, at the same time, to insure a good ovality of the rolled stock. Here, with a round profile of the stock, the stands with oval passes should have a relatively high rigidity, and the stands with a round pass should have a smaller, optimal rigidity.

Thus, optimally, the following adjustments should be made:

- The rolling force-caused spring-off of the last sizing stand should be compensated to a smaller degree than the spring-off of the preceding sizing stand;
- The rolling force-caused spring-off of the last pre-sizing stand should be compensated to a smaller degree than the spring-off of the preceding pre-sizing stand; and
- The rolling force-caused spring-offs of the reduction stands should be compensated almost completely.

The last two active rolling mill stands operate in a sizing mode. At least one rolling mill stand of a rolling mill stand pair immediately preceding the sizing stands operate in a pre-sizing mode. Due to the adjustability of the fraction of the rolling force-caused spring-offs of the rolling mill stands, it is easy to adjust the rolling mill stands for operation in a sizing, pre-sizing, or reduction made.

The ovality of the rolled stock is particularly good when the rolling force-caused spring-offs of the sizing stands are on average, compensated to a smaller degree than the spring-offs of the pre-sizing stands.

The tolerances are best maintained when the stock is so rolled in the pre-sizing stands that the sizing stands can operate in their most favorable dynamic region. This can be achieved, e.g., by determining the roll nips of the pre-sizing stands based on the roll nips of the sizing stands.

The dimension precision of the rolled stock can be increased by providing, downstream of the last sizing stand, a measuring device for measuring the end height and the end width of the rolled stock and by correcting the roll nips of the sizing stands based on the measured end height and width (monitor routine).

The precision of the dimension of the rolled stock can be further increased by providing further measuring devices arranged, respectively downstream of each pair of rolling mill stands for measuring the height and the width of the rolled stock as it leaves a respective pair. In this case, the roll nips of respective rolling mill stands can be directly determined from the measured height and width.

Usually, the draw of the rolled stock between separate rolling mill stands is determined, and their rotational speed is so controlled that the draw remains constant. In addition, it is possible to measure the cross-section of the rolled stock between the separate rolling mill stands. The measurements of the draw, heights and width during rolling can be used for optimizing the fractions of the rolling force-caused spring-offs which are to be compensated.

When a new stock is rolled, it could be possible to provide that the first billet of the charge has correct end dimensions. This can be achieved by providing memory means for storing material characteristics, end heights and end width of already rolled stocks, and for storing constant and set-up parameters of the rolling mill stands; by providing input means for inputting material characteristics, end height and end width of a new to-be-rolled stock, and by providing comparison means for comparing the material characteristics, the height and the width for the new to-be-rolled stock with the stored material characteristics, the end heights and the end width for the already rolled stocks, and for comparing instantaneous parameters of the rolling mill stands during rolling of the new rolled stock with the stored parameters of the rolling mill stands, whereby upon coincidence of the parameters for the new stock with the stored parameters for an already rolled stock, the rolling mill stands can be preadjusted to set-up parameters for the already rolled stock with corresponding material characteristics and end measurements.

The constant parameter includes the roll diameters. The set-up parameters includes the roll nips, roll rotational speeds, and the fractions of the rolling force-caused spring-offs which are compensated. The material characteristics includes, in particular, the temperature, initial dimensions, and the quality of the rolled stock.

With a preliminary adjustment, it is possible to optimally roll a new billet when its material characteristics exactly correspond to the characteristics available in the memory.

When a plurality of rolling parameters of the already rolled stocks are stored in the memory, and the rolling mill train includes a comparison device for comparing at least one rolling parameter of rolling of the new stock with a rolling parameter corresponding to new set-up parameters of the rolling mill stands, and an output device for generating an alarm signal upon a noticeable deviation of the at least one rolling parameter upon rolling of the new stock from the like parameter corresponding to the new set-up parameters of the rolling mill stands, it is possible to verify whether the new stock indeed has the given material characteristics. The rolling parameters includes, in particular a rolling force or a rolling torque.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
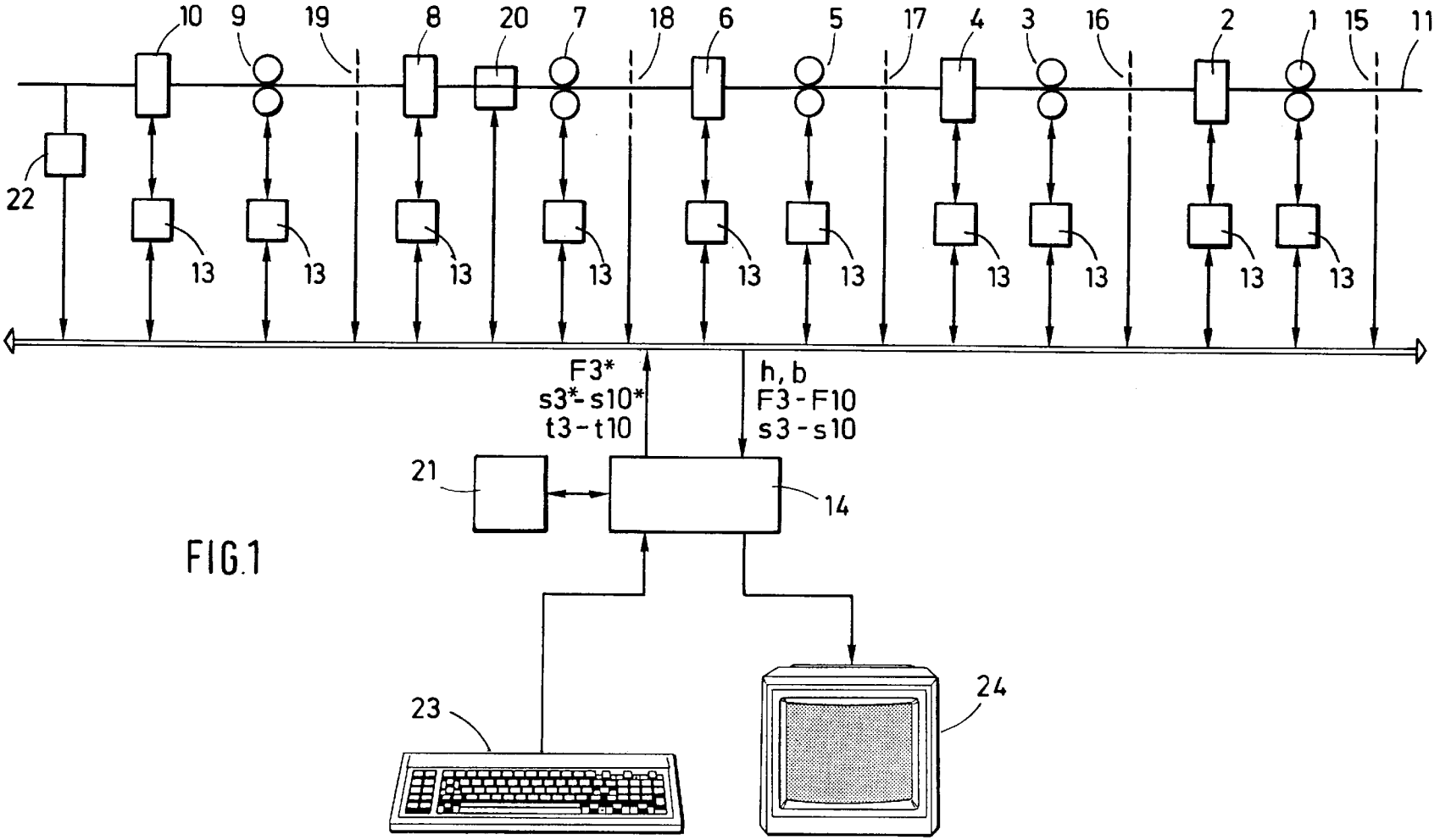
FIG. 1 a schematic view of a rolling mill train according to the present invention for producing bar-shaped rolled products.

A rolling mill train according to the present invention, which is shown in FIG. 1, includes a plurality of arranged one after another rolling mill stands 1–10 through which a rolled stock 11 passes. In the present case, the rolled stock 11 is a bar-shaped stock, e.g., bar steel or wire. The rolled stock 11 passes through the rolling mill train starting from the rolling mill stand 10. The rolled stock 11 exits the rolling mill train after passing through the rolling mill stand 1. The rolling mill stands 1–10 are alternatively formed as horizontal rolling mill stands and vertical rolling mill stands. The have, e.g., alternating round and oval grooves.

The rolling mill stand 1, which is last passed through by the rolled stock 11 has, e.g., a round groove. Two following each other rolling mill stands 1–10 form a rolling mill stand pair.

The rolling mill stands 1–10 roll the rolled stock 11 by applying rolling forces F3–F10 to an end height h and, transverse thereto, an end width b. The two last rolling mills stands 1 and 2 remain inactive in the discussed embodiment of the rolling mill train, i.e., they do not roll the rolled stock 11. The rolled stock 11 just passes through the last two stands 2 and 1. Thus, only eight rolling mill stands 3–10 are active. The use of only eight rolling mill stands is possible because, in the discussed embodiment, the end dimensions h and b of the rolled stock 11 are relatively large. With small dimensions h and b, the last two stands 1 and 2 also will be activated.

When the rolling mill train with stands 1–10 is equipped with quick changing devices, the inactive stands 1–2 are removed and are moved in only if necessary.

All of the rolling mill stands 1–10 are formed in the same manner. Therefore, below only the structure of the rolling mill stand 3 will be described.

Figure 2:
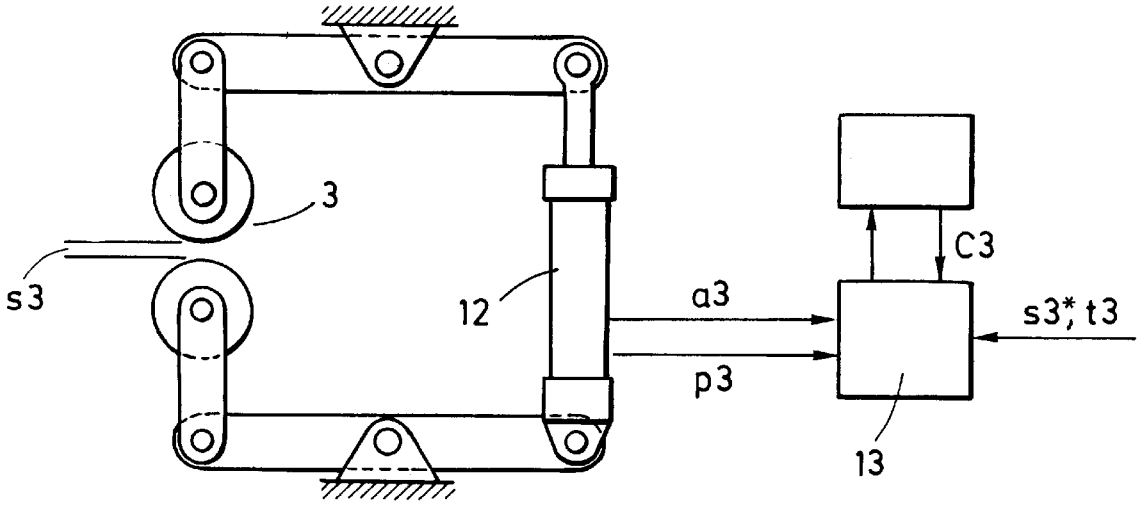
FIG. 2 a schematic view of a hydraulic cylinder unit for controlling a roll nip.

According to FIG. 2, the rolling mill stand 3 is associated with a hydraulic cylinder unit 12 which regulates or controls the roll nip S3. The necessary rolling force F3 is determined by the hydraulic cylinder unit 12 and by a working pressure P3 generated by the hydraulic cylinder unit 12. The hydraulic cylinder unit 12 is controlled by a roll nip control unit 13.

Before the start of the rolling process, the roll nip control unit 13 controls the hydraulic cylinder unit 12 in such a way that the roll nip S3 is closed. The working pressure P3 is practically zero. With a completely closed roll nip 3, the working pressure P3 increases. Due to the increase of the working pressure P3, the force F3 acting on the rolling mill stand 3 also increases. As a result, the rolls of the rolling mill stand 3 spring away form each other. The roll nip control unit constantly transmits at what pressure P3 what setting range a3 the hydraulic cylinder unit 12 should provide. Based on this measurement curve, the roll nip control unit 13 can determine a zero point of the roll nip S3 and the spring constant C3 of the rolling mill stand 3. The spring constant is necessary for the determination, during rolling, springing-off of the rolls which is caused by the separation force, with the spring-off being a product of the spring constant C3 and the separation force F3.

At the start of rolling, the roll nip control unit 13 presets a predetermined roll nip S3* and an expected separation force F3*. Based on the known zero point of the roll nip S3 and the known spring constant C3, the roll nip control unit 13 so controls the hydraulic cylinder unit 12 that the rolling mill stand 3, after the spring-off of the rolls, has a preset roll nip S3*.

Due to different factors such as, e.g., eccentricity of the rolls, cross-sectional deviations of the rolled stock 11, temperature deviations of the rolled stock 11, etc . . . , the separation force F3 varies during rolling of the roll stock 11. As a result, the rolls of the rolling mill stand 3 spring away from each other in accordance with the variable separation force F3 to a greater or lesser degree. Based on the known springing characteristics of the rolling mill stand 3, the spring-off, which is caused by a separation force C3 (F3-F3*) can be constantly compensated by the determination of the working pressure P3 and a corresponding correction of the setting range a3. However, with the bar-shaped rolled stock 11, this would result in that the height h of the rolled stock 11 exiting the rolling mill stand 3 would be correct, but the entire rolling error would be transmitted to the width b. Advantageously, the spring-off of the rolling mill stand 3 would be reduced by appropriate compensation only to a fraction t3. The fraction t3 will be preset in the roll nip control unit 13 with a higher order computer 14.

The above-discussed adjustment of the rolling mill stand 3 is applicable to any active rolling mill stand 4–10. In particular, in the active rolling mill stands 4–10, a preset roll nip S4*–S10*, an expected separation force F4*–F10*, and a respective fraction t4–t10 are preset.

The sizing rolling mill stands 3, 4 only then operate with an optimal dynamics when the cross-section of the rolled stock 11 passing therethrough lies in a predetermined cross-sectional range. To this end, the rolled stock 11 need be so rolled in the rolling mill stands 5, 6, which immediately precede the rolling mill stands 3, 4, that the sizing stands 3,4 operate in their most favorable dynamic region. The rolling mill stands 5, 6 operate as so-called pre-sizing stands.

Further rolling mill stands 7–10 are arranged in front of the pre-sizing rolling mill stands 5, 6.

In the rolling mill stands 7–10, the rolled stock 11 is reduced to the most possible extent so that it can be rolled to its end dimensions h and b with a minimal total number of passes. The rolling mill stands 7–10 operate as so-called reduction stands.

In the embodiment of the invention described here only the rolling mill stands 5, 6 operate as pre-sizing stands. In principle, rolling will stands of two or even three rolling mill stand pairs can operate as pre-sizing stands.

The fractions t3–t10, to which the spring-off of the rolling mill stands caused by separation forces need be compensated, are adjusted separately for each stand. In practice, the following adjustments proved themselves to be particularly advantageous:

- The spring-off of the sizing stand 3, which is caused by separation forces, is compensated to a smaller fraction t3 than the separation force-caused spring-off of the sizing stand 4.
- The spring-off of the pre-sizing stand 5, which is caused by separation forces, is compensated to a smaller fraction t5 than the separation force-caused spring-off of the pre-sizing stand 6.
- The separation force-caused spring-offs of the sizing stands 3, 4 are compensated to smaller fractions t3, t4 then the separation force-caused springs-off of the pre-sizing stands 5, 6.
- The separation force-caused spring-offs of the reduction stands 7–10 are compensated up to 90%–100%, i.e., almost entirely.

Already this compensation of the separation force-caused spring-offs of the rolling mill stands alone noticeably increases the quality of the rolled stock. According to FIG. 1, a measuring device 15 is provided downstream of the non-active rolling mill stands 1 and 2 for measuring the end height h and the end width b of the rolled stock 11. The measured end values h and b are transmitted to a higher order computer 14. The computer 14 constantly calculates the preset new roll nips S3*, S4* for the sizing stands 3 and 4. Thus, the roll nips S3, S4 are corrected based on detected end height h and end width b.

Based on the transmitted end measurements h and b and the preset roll nips S3*, S4* of the sizing stands 3, 4, the computer can calculate the dimensions of the rolled stock 11 between the rolling mill stands 4 and 5. Based on these calculated dimensions, the computer 14 can determine also the preset roll nips S5*, S6* for the pre-sizing stands 5, 6 and can preset the controlled parameters for controlling their roll nips.

It is, however, possible, alternatively, in addition to the measuring device 15, to arrange upstream of the measuring device 15, further measuring devices 16–19 immediately downstream of the sizing stand pair, pre-sizing stand pair, and at least one reduction stand pair of reduction stand pairs, respectively. Then, the computer 14 can calculate respective control parameters for the separate rolling mill stands 3–10, indicating to what preset roll nips S3*–S10* they need be adjusted.

Draught gauges are arranged between the rolling mill stands 1–10 of which only one, namely, a draught gauge 20, is shown. The measurement values, which are determined by the draught gauges, are likewise transmitted to the computer 14. The draught gauges permit to determine, by comparing the draught measurement with the adjustments of the rolling mill stands 1–10, whether the fractions t3–t10 for compensating the separation force-caused spring-offs are optimally adjusted. If necessary, the respective fractions t3–t10 can be corrected and optimized.

This correction is obviously facilitated when the measuring devices 16–19 are available. Then, based on the obtained measurements, of heights and widths of the rolled stock 11 downstream of the rolling mill stands 9, 7, 5, and 3, an optimal value of the fractions t3–t10 can be determined.

A data set for each already rolled stock 11 is stored in a memory 21 of the computer 14. The data set includes roll diameters of the rolling mill stands 1–10 as a constant parameter, on one hand, and stand operational parameters s3–s10, t3–t10 of the rolling mill stand 1–10, on the other hand. For each of rolling mill stands 1–10, the following data are stored in particular: roll diameters, roll nips s3–s10, roll rational speeds, and the fractions t3–t10. Further are stored the temperature, and initial dimensions and the quality of a rolled stock 11. The data set further includes, for each rolled stock 11 to-be-rolled an end height h and an end width b. Finally, the data set includes rolling parameters F3–F10, which are obtained during rolling, i.e., separation forces F3–F10 and/or rolling torques.

The temperature of the rolled stock can be determined, e.g., with a temperature measuring device 22 arranged at the inlet of the rolling mill train. The characteristics of the material of the rolling stock 11 can, e.g. be input into the computer with keyboard 23 which serves as an input device.

A plurality of such data sets (one set per each rolled stock) are stored in the memory 21. When a new to-be-rolled stock 11 need be produced, then the characteristics of its material and its end dimensions h and b are input into the computer 14. The computer then compares the input data of the new to-be-rolled stock 11 with the stored data sets. If it funds a data set the material characteristics and the end dimensions h and b of which coincide with those input for the to-be-rolled stock, the computer compares the instant stand parameters with the stored stand parameters. If those coincide, then the computer retrieves corresponding parameters s3–s1, t3–t10 from the memory 21 and transmits those parameters to respective roll nip control units 13 of respective rolling mill stands 1–10. Thereby, it is possible already with the first billet of a new charge to obtain the desired end dimensions h and b with good tolerances. A long setting-up of correct parameters s3–s10, t3–t10 becomes unnecessary. In addition, obviously, new parameters F3–F10 of the rolling mill stands 1–10, which are obtained during rolling of the new rolled stock 11, are transmitted to the computer 14, together with the applied separation forces F3–F10. The computer 14 compares the new values with the previously stored values of the separation forces F3–F10 for a previously rolled stock with identical stock parameters. If noticeable deviations are observed upon comparison, it is an indication that the new stock 11 does not correspond to the previously rolled stock 11. In this case, an output device 24, e.g., a monitor, generates an alarm signal. Based on this alarm signal, an operator can effect necessary adjustments of the rolling mill stands 1–10 and initiate an analysis of the new rolled stock 11.

The above-described rolling mill train permits to achieve up to the present unachievable flexibility of rolling of rolled stocks 11. In particular, each rolling mill stand 1–10 is separately activated. Further, in each rolling mill stand 1–10, the fraction t3–t10 of its separation force-caused spring-off is separately compensated. Further, for each rolling mill stand 1–10, it is determined whether an adjustment, i.e., the correction of its set roll nip s3*–s10* based on the measured height h and width b is to be undertaken or not.

As a result, each rolling mill stand 1–10 can operate as a sizing stand, as a pre-sizing stand, or as a reduction stand. Thus, this is not any more a question of a construction of respective rolling mill stands 1–10, but rather a question of a corresponding adjustment of the roll nip control parameters which can be undertaken within seconds.

According to the discussed embodiment of the present invention, all of the rolling mill stands 1–10 have the same constructions. All of the rolling mill stands 1–10 are adjusted by respective hydraulic cylinder units 12. If it is known in advance that only some of the rolling mill stands 1–10 will be used as sizing and pre-sizing stands, the other rolling mill stands, e.g., the stands 9 and 10 can be adjusted in a different manner. However, at least the last four active rolling mill stands 3–6 should be adjusted with hydraulic means.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A rolling mill train for rolling a bar-shaped stock to a predetermined end height and end width measured transverse to the end height, the rolling mill train comprising a plurality of arranged one after another, active rolling mill stands having adjustable roll nips and forming rolling mill stand pairs; a respective plurality of hydraulic cylinder units for adjusting the roll nips of respective rolling mill stands; a respective plurality of roll nip control units for controlling the respective hydraulic cylinder units so that at least a fraction, individual for each of the rolling mill stands, of rolling force-caused spring-offs of the respective rolling mill stands is compensated; memory means for storing material characteristics, end heights and end width of already rolled stocks, and for storing constant and set-up parameters of the rolling mill stands; input means for inputting material characteristics, end height and end width of a new to-be-rolled stock, and comparison means for comparing the material characteristics, the height and the width for the new to-be-rolled stock with the stored material characteristics, the end heights and the end width for the already rolled stocks, and for comparing instantaneous parameters of the rolling mill stands during rolling of the new rolled stock with the stored parameters of the rolling mill stands, whereby upon coincidence of the parameters for the new stock with the stored parameters for an already rolled stock, the rolling mill stands are pre-adjusted to set-up parameters for the already rolled stock with the material characteristics, end height and width corresponding to the new stock.

2. A rolling mill train as set forth in claim 1, further comprising output means for generating an alarm signal upon a noticeable deviation of at least one rolling parameter upon rolling of the new stock from a like stored parameter corresponding to new rolling mill stand set-up parameters for rolling the new stock.

3. A method of rolling a bar-shaped stock to predetermined end height and end width measured transverse to the end height, the method comprising the steps of providing a rolling mill train including a plurality of arranged one after another active rolling mill stands having adjustable roll nips and forming rolling mill stand pairs; providing a respective plurality of hydraulic cylinder units for adjusting the roll nips of respective rolling mill stands; rolling the bar-shaped stock through the rolling mill stands; compensating at least a fraction, individual for each of the plurality of rolling mill stands, of rolling force-caused spring-offs of the respective rolling mill stands by controlling operations of respective hydraulic units; storing material characteristics, end heights and end width of already rolled stocks, and constant and set-up parameters of the rolling mill stands; inputting material characteristics, end height and end width of a new to-be-rolled stock; and comparing the material characteristics, the height and width of the new to-be-rolled stock with the stored material characteristics, the end heights and the end width of the already rolled stocks and comparing instantaneous set-up parameters of the rolling mill stands during rolling of the new rolled stock with the stored set-up parameters, whereby upon coincidence of the parameters for the new stock with the stored parameters for already rolled stock, the rolling mill stands are preadjusted to set-up parameters for the already rolled stock with the corresponding material characteristics, end height and end width.

4. A method as set forth in claim 3, wherein the step of storing of the constant and set-up parameters of the rolling mill stands includes storing of roll diameters, the roll nips, roll rotational speeds, and compensated fractions of the rolling force-caused spring-offs of the rolling mill stands.

5. A method as set forth in claim 3, wherein the step of storing material characteristics includes storing of a temperature, initial dimensions, and quality of the already rolled stocks.

6. A method as set forth in claim 3, further comprising the steps of storing a plurality of rolling parameters of the already rolled stocks, comparing a rolling parameter of the new stock with a rolling parameter corresponding to new set-up parameters of the rolling mill stands, and generating an alarm signal upon a noticeable deviation of the rolling parameter of the new stock from the rolling parameter corresponding to the new set-up parameters of the rolling mill stands.

7. A method as set forth in claim 6, wherein the rolling parameter includes one of a separation force and a rolling torque.

8. A rolling mill train for rolling a bar-shaped stock to a predetermined end height and end width measured transverse to the end height, the rolling mill train comprising a plurality of arranged one after another, active rolling mill stands having adjustable roll nips and forming rolling mill stand pairs; a respective plurality of hydraulic cylinder units for adjusting the roll nips of respective rolling mill stands; and a respective plurality of roll nip control units for controlling the respective hydraulic cylinder units so that for each rolling mill stand, a fraction individual for a respective rolling mill stand, of rolling force-caused spring-offs of the respective rolling mill stand is compensated.

9. A rolling mill train as set forth in claim 8, wherein rolling mill stands of a last pair of the rolling mill stand pairs are formed as sizing stands, and wherein the rolling mill train further comprises a measuring device located downstream of a last sizing stand of the last pair of the sizing rolling mill stands for measuring the end height and the end width, and means for calculating a necessary correction of the roll nips of the sizing stands in accordance with the measured height and width.

10. A rolling mill train as set forth in claim 9, comprising further measuring devices arranged, respectively, downstream of each pair of rolling mill stands for measuring the height and the width of the rolled stock as the rolled stock leaves a respective rolling mill stand pair.

11. A rolling mill train as set forth in claim 8, further comprising means for measuring temperature of the rolled stock.

12. A method of rolling a bar-shaped stock to predetermined end height and end width measured transverse to the end height, the method comprising the steps of providing a rolling mill train including a plurality of arranged one after another active rolling mill stands having adjustable roll nips and forming rolling mill stand pairs; providing a respective plurality of hydraulic cylinder units for adjusting the roll nips of respective rolling mill stands; rolling the bar-shaped stock through the rolling stands for each; and compensating at least a fraction individual for a respective rolling mill stand, of rolling force-caused spring-offs of the respective rolling mill stand by controlling operations of a respective hydraulic unit.

13. A method as set forth in claim 12, wherein the rolling mill train providing step includes forming rolling mill stands of a last pair of the rolling mill stand pairs as sizing stands, and wherein the compensating step includes compensating, in a last sizing rolling mill stand of the pair of the sizing rolling mill stand pairs, a smaller fraction of the rolling force-caused spring-off than in a preceding sizing rolling mill stand.

14. A method as set forth in claim 13, wherein the rolling mill train providing step includes forming rolling mill stands of a pair of rolling mill stand immediately preceding the pair of the sizing rolling mill stand pairs as pre-sizing stands; and wherein the rolling step includes rolling the stock through the pre-sizing stands in such a way that the sizing stands are able to operate in a most favorable dynamic region thereof.

15. A method as set forth in claim 14, wherein the compensating step includes compensating, in a last of the pre-sizing stands, a smaller fraction of the rolling force-caused spring-off than in a preceding pre-sizing stand.

16. A method as set forth in claim 14, wherein the compensating step includes compensating, in the sizing stands, smaller fractions of the rolling force-caused spring-offs than in the pre-sizing stands.

17. A method as set forth in claim 14, wherein the roll nips of the pre-sizing stands are determined based on the roll nips of the sizing stands.

18. A method as set forth in claim 14, wherein the rolling mill train providing step includes forming the rolling mill stands of at least one pair of the rolling mill stand pairs, which immediately precedes the pre-sizing stand pair, as reduction stands in which the rolled stock is reduced to a most possible extent.

19. A method as set forth in claim 14, wherein the compensating step includes compensation of substantially entire spring-offs of the reduction stands.

20. A method as set forth in claim 13, further comprising the steps of measuring the end height and the end width downstream of the last stand of the rolling mill train, and correcting the roll nips of the sizing stands based on the measured end height and end width.

21. A method as set forth in claim 12, further comprising the step of measuring the temperature of the rolled stock.

22. A method as set forth in claim 12, wherein the compensating step includes optimizing of the fractions of the rolling force-caused spring-offs of the rolling mill stands based on at least one of tension, height and width measurements.

* * * * *